US006935914B2

(12) United States Patent
Ito et al.

(10) Patent No.: US 6,935,914 B2
(45) Date of Patent: Aug. 30, 2005

(54) DISPLAY PANEL AND METHOD OF FABRICATING THE SAME

(75) Inventors: Atsushi Ito, Tokyo (JP); Hironobu Arimoto, Tokyo (JP)

(73) Assignee: Mitsubishi Denki Kabushiki Kaisha, Tokyo (JP)

( * ) Notice: Subject to any disclaimer, the term of this patent is extended or adjusted under 35 U.S.C. 154(b) by 209 days.

(21) Appl. No.: 09/842,778

(22) Filed: Apr. 27, 2001

(65) Prior Publication Data

US 2001/0023161 A1 Sep. 20, 2001

Related U.S. Application Data

(62) Division of application No. 09/247,061, filed on Feb. 9, 1999, now Pat. No. 6,252,345.

(30) Foreign Application Priority Data

Sep. 30, 1998 (JP) ..... HEI 10-276731

(51) Int. Cl.[7] ..... H01J 9/00; H01J 9/20

(52) U.S. Cl. ..... 445/22; 445/24; 313/478

(58) Field of Search ..... 313/461–462, 313/466, 478, 680, 473, 474, 470, 111, 480; 445/22, 24; 250/216

(56) References Cited

U.S. PATENT DOCUMENTS

| | | | | | |
|---|---|---|---|---|---|
| 4,414,316 | A | * | 11/1983 | Conley | 430/496 |
| 4,667,092 | A | * | 5/1987 | Ishihara | 250/216 |
| 5,126,620 | A | * | 6/1992 | Haraga et al. | 313/111 |
| 5,461,495 | A | * | 10/1995 | Steenblik et al. | 359/463 |
| 5,466,926 | A | * | 11/1995 | Sasano et al. | 250/216 |
| 5,543,942 | A | * | 8/1996 | Mizuguchi et al. | 349/5 |
| 5,568,313 | A | * | 10/1996 | Steenblik et al. | 359/463 |
| 5,836,798 | A | * | 11/1998 | Dannoux et al. | 439/604 |
| 5,939,826 | A | * | 8/1999 | Ohsawa et al. | 313/582 |
| 6,072,274 | A | * | 6/2000 | Jondrow | 313/495 |
| 6,570,324 | B1 | * | 5/2003 | Tutt et al. | 313/500 |

FOREIGN PATENT DOCUMENTS

| | | | | |
|---|---|---|---|---|
| DE | 946 153 | | 7/1956 | |
| EP | 0 375 377 | A1 | 6/1990 | |
| JP | 2-181781 | | 7/1990 | |
| JP | 2267842 | | 11/1990 | |
| JP | 487145 | | 3/1992 | |
| JP | 4298945 | | 10/1992 | |
| JP | 04298945 | A * | 10/1992 | ..... H01J/31/15 |
| JP | 5089850 | | 4/1993 | |
| JP | 6231706 | A * | 8/1994 | |
| JP | 6231706 | | 8/1994 | |
| JP | 07-225303 | A | 6/1995 | |
| JP | 8-201793 | | 8/1996 | |
| JP | 8-207159 | | 8/1996 | |
| JP | 9-49903 | A | 2/1997 | |
| JP | 9274103 | | 10/1997 | |
| JP | 10-104657 | | 4/1998 | |
| JP | 10-214567 | | 8/1998 | |

OTHER PUBLICATIONS

"Conservation and Art Material Encyclopedia Online;" printed webpage of Material Descriptions of cadmium sulfide, chromium oxide, and cobalt oxide, Museum of Fine Arts, Boston; 2004.*

* cited by examiner

*Primary Examiner*—Joseph Williams
*Assistant Examiner*—Peter Macchiarolo
(74) *Attorney, Agent, or Firm*—Rothwell, Figg, Ernst & Manbeck, P.C.

(57) ABSTRACT

A display panel includes a resin lens layer. The display panel consists of a front panel 10 and a back panel 12 which are hermetically sealed together. The display panel also includes a plurality of display cells and is filled with a gas. A visible-light transparent resin is coated over the front surface of the front panel 10. The resin layer is raise-molded with a molding tool 16 while being solidified. Through this molding process, a resin lens layer 14 with plural lenses is formed on the front surface of the front panel 10. The resin lens layer 14 formed on the front surface of the front panel 10 can improve the brightness of the display cells.

3 Claims, 3 Drawing Sheets

DISPLAY PANEL AND METHOD OF FABRICATING THE SAME

BACKGROUND OF THE INVENTION

1. Field of the Invention

The present invention relates to a method of fabricating a display panel having a luminous portion which emits light concentrated in the viewing direction, and particularly to a lens disposed on the front of the front panel.

2. Description of the Related Art

Conventionally, there are various display devices such as CRTs and plasma displays. For such display devices, there is a strong demand to increase brightness as much as possible. In the self-luminous-type display devices such as CRTs and plasma displays, the produced light is emitted with no directivity and relatively diverges in the viewing direction. This type of display device has the advantage of a wide angle of view. However, most of the emitted light diverges in other directions, not to a user which is on the front of the display panel, and the brightness efficiency is poor.

In order to improve the poor brightness efficiency, a display panel has been proposed wherein micro lens groups are disposed on the front surface to condense the diverged light towards the front. This structure enables the brightness of the display panel to be improved, even when the same amount of light is emitted.

A typical CRT or plasma display has a glass front panel. Lenses can theoretically be formed on the top surface of the front panel, but it is in practice very difficult to form lenses on the top surface of the CRT. Lenses can be formed on the glass display panel but may be deformed in the sealing and sintered process to seal the inner space of the display panel structure. In either case, one-piece molding lenses with the display panel makes the front panel quite expensive.

One practical method is made by the steps of fabricating a lens panel with a heat-resistant transparent material such as glass or polycarbonate and then bonding the lens panel to the front surface of the front panel with an adhesive agent. However, this method has a serious disadvantage in that the display panel becomes heavier because of the attached member and that a long distance between the lens and the luminous position decreases the light-condensing angle, thus narrowing the angle of view. A one-piece molding technique is disclosed, for example, in Japanese Patent Laid-open Publication No. Hei 2-267842(Nov. 11, 1990).

SUMMARY OF THE INVENTION

It is an object of the invention is to provide a display panel in which a light, effective, resin lens layer is provided.

Another object of the invention is to provide a method of fabricating a display panel in which a light, effective, resin lens layer can be provided in a simplified manner.

According to the present invention, a display panel which has a front surface through which light from a luminous portion is emitted, comprises a front panel covering the front surface of the luminous portion and a resin lens layer formed directly on the front panel. This resin lens layer includes a plurality of lenses, each of which condenses light from the luminous portion forwards. The brightness of the display cell can be improved by directing light from the luminous portion towards the front.

Moreover, according to the present invention, a method of fabricating a display panel having a front surface through which light from a luminous portion is emitted, comprises the steps of coating a resin material over a front panel covering the front surface of the luminous portion to form a resin layer; pressing a molding tool against the front surface of the resin layer; and separating the molding tool from the front surface of the resin layer, thereby forming a plurality of lenses on the resin layer, each of the which condenses light from a display cell in the forward direction thereof. Thus, a lightweight lens can be easily fabricated near the luminous portion.

The luminous portion may preferably have a plurality of display cells disposed in a matrix form, each emitting light through discharge. The non-directional light produced by discharge is then condensed to the viewing direction, so that the brightness of the display cell is effectively improved.

Furthermore, the resin lens layer may preferably contain a pigment in a mixed state and act as a filter. A gray filter can cut external light and thus improving the contrast, while the use of Red(R), Green(G), and Blue(B) filters corresponding to respective R, G, and B luminous portions further improves contrast.

The display panel with the above structure has the following advantages.

Since a resin lens layer which including a plurality of lenses each condensing light from a luminous portion on the front side is formed on the front panel, the light from the luminous portion can be directed forwards so that the brightness of display cells can be improved.

According to the present invention, a resin material is coated over a front panel covering the front surface of the luminous portion to form a resin layer. A molding tool is pressed against the front surface of the resin layer and then removed so as to form a plurality of lenses on the resin layer, each condensing light from a display cell on the front side thereof. Hence, a lightweight lens can be easily formed near the luminous portion.

Since the luminous portion has a plurality of display cells disposed in a matrix form, and as each of the display cells emits light through a discharge, the non-directional light produced by a discharge is condensed forwards so that display cell brightness can be effectively improved.

Moreover, since the resin lens layer contains a pigment in a mixed state and acts as a filter, the contrast can be improved. For example, when a gray filter is used as the filter, the contrast can be increased by cutting the external light. By using R, G, and B filters respectively corresponding to R, G, and B luminous portions, the contrast can be further increased.

BRIEF DESCRIPTION OF THE DRAWINGS

This and other objects, features and advantages of the present invention will become more apparent from the following detailed description and drawings, in which.

DESCRIPTION OF THE PREFERRED EMBODIMENTS

Preferred embodiments of the present invention will be described below with reference to the attached drawings.

Figure 1:
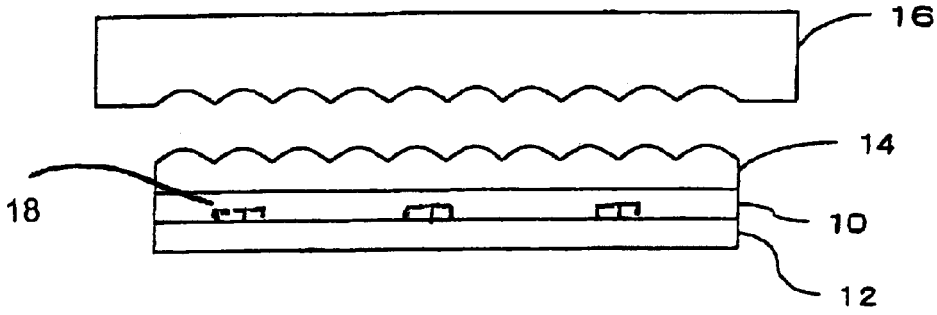
FIG. 1 is a cross sectional view schematically illustrating a resin lens layer according to a first embodiment of the present invention.
Figure 5:
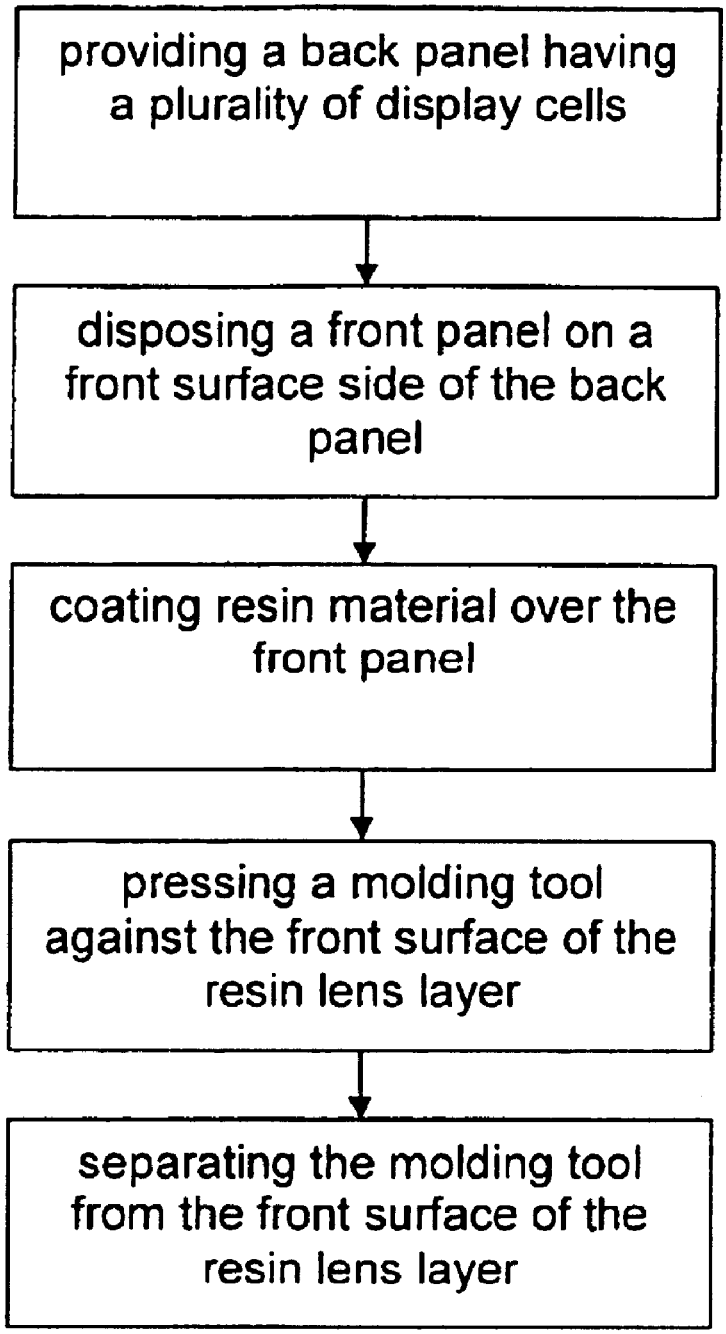
FIG. 5 is a flow diagram of the method of fabricating a display panel according to the present invention.

Embodiment 1:

FIG. 1 is a cross sectional view illustrating the configuration of a display panel with a resin lens layer according to the first embodiment of the present invention, and FIG. 5 is a flow diagram of the method of fabricating a display panel according to the present invention. A glass front panel 10 and a back panel 12 are combined together and frit sealed. The combined structure is filled with a gas such as xenon (Xe).

Transparent electrode pairs 18 of, for example, ITO are formed in a display pattern on the back surface of the front panel 10. In each transparent electrode pair, one electrode acts as a common electrode connected to all cell electrodes while the other electrode is a respective electrode from which a terminal is taken out. Both the dielectric film silk-screened and the protective film (MgO) vapor-deposited are formed over the transparent electrode pattern.

The back panel 12 is sandblasted to form recessed portions each acting as a discharge space for a display cell. Predetermined display pulses are applied to the common electrode, while control voltages are respectively applied to the respective electrodes. Thus, respective display cells are controlled by controlling the discharge of each display cell.

In this example, the size of the front panel 10 and of the back panel forming a display element 12 is 8 cm×8 cm, the size of one display cell is 3 mm×9 mm, the display cell including R, G, and B forms a pixel of 10 mm square. A display panel is formed by combining the display elements together.

A resin film with a visible light transmittance of more than 90% is coated on the front surface of the front panel 10 through a dispensing or printing step.

Before the resin film is solidified, a molding tool 16 is placed on the resin film to form lenses, each of which can condense light towards the front of the display panel. The molding tool 16 is pressed or weighted to press against the resin film. In such a state, the resin film is hardened. When the resin film is of a low temperature setting resin, it is thermally set in a thermal process. After the hardening process, the molding tool 16 is removed from the resin lens layer 14 formed on the front surface of the front panel 10.

Epoxy, acrylic, silicone, polycarbonate, or such a resin may be used for the resin lens layer 14. The epoxy resin is preferably selected by considering heat-resistance, chemical resistance, light transparency, and cost.

Moreover, it is important to select a molding tool 16 which has good nonstick properties to the resin lens layer 14. Teflon (a trade name of Du Pont) has good nonstick properties to many resin materials and may preferably be used for the molding tool 16. Certain metals may also be used for the molding tool 16, as may a metal whose surface is coated with Teflon.

Figure 2:
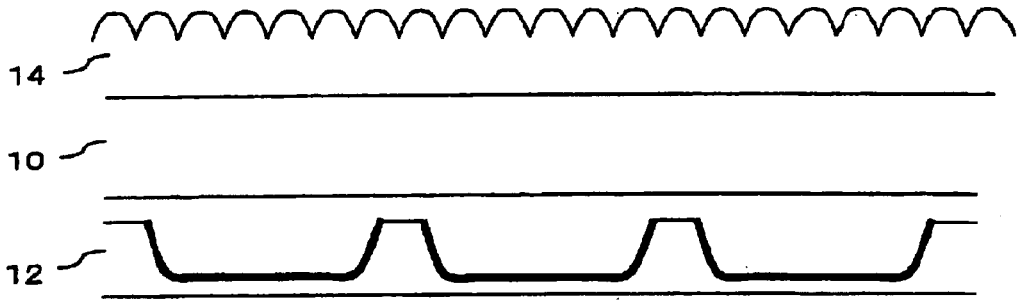
FIG. 2 is a cross-sectional view schematically illustrating the configuration of a resin lens layer according to the first embodiment of the present invention.

The lens layer, on which hemispherical micro lenses are arranged as shown in FIG. 2, may be used as the resin lens layer 14. Each micro lens gathers light from the luminous portion at the front. The thickness of the resin lens layer 14 preferably corresponds to a value ranging several tens of $\mu$m to several hundreds of $\mu$m.

Figure 3:
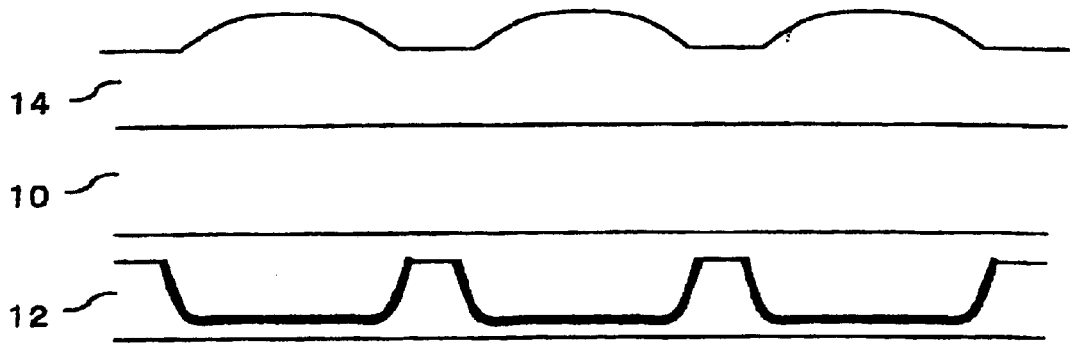
FIG. 3 is a cross-sectional view schematically illustrating another configuration of a resin lens layer according to the first embodiment of the present invention.

As shown in FIG. 3, each lens element may be formed corresponding to a display cell. Specifically, in this example, the size of each display cell is approximately 3×9 mm, and each lens element has a semicircular form corresponding to the display cell. The display cell may be slantwise viewed but is rarely viewed at a large angle from above the panel or below the panel. Hence, it is preferable that the longer (axial) side of the semicircular lens be disposed in the traverse (horizontal) direction. A cylindrical lens with a given width extending in the horizontal direction may be employed as the resin lens.

Referring to FIGS. 2 and 3, the recessed portions formed in the back panel 12 define respective discharge spaces. A fluorescent substance layer is coated on the inner surface of each recessed portion. A fluorescent substance layer is coated for a green (G) display cell, for a red (R) display cell, and for a blue (B) display cell. The three display cells together form one pixel.

Embodiment 2:

In the resin lens layer 14, a filter function for cutting external light can be provided by mixing the resin with a black pigment and then hardening them, so that the display contrast can be improved.

Figure 4:
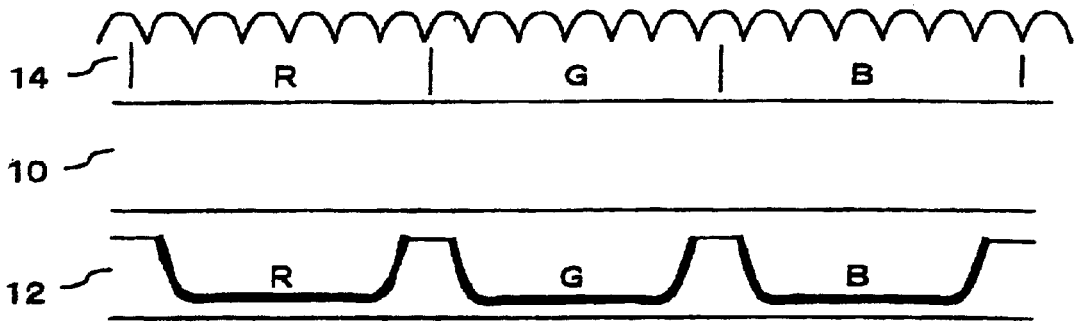
FIG. 4 is a cross-sectional view schematically illustrating a color filter according to a second embodiment of the present invention.

Moreover, as shown in FIG. 4, the red (R) pigment mixed region may be preferably formed corresponding to the R display cell; the green (G) pigment mixed region may be preferably formed corresponding to the G display cell; and the blue (B) pigment mixed region may be preferably formed corresponding to the B display cell. For example, a color filter lens can be formed by coating three color resins onto the front panel in the pad printing step and then thermally setting them. This process can further improve the contrast. In this case, since resins for three colors must be applied through the pad printing process and then hardened, it is preferable to use resins with high viscosity. Moreover, it is preferable to dispose partition walls each which prevents a color resin from being mixed with a different color resin adjacent to the color resin. The R, G, and B filters may be formed after formation of a gray filter acting as a partition wall.

For example, R-DV005 (red), G-DV005 (green), and B-DV005 (blue) (trade names manufactured by Hanahara Chemical Co., Ltd. may be used as a pigment containing resin. These chemicals contain a colorant, additives, and a binder (90% or more) and can be coated to form R, G, and B color filters. In order to form a gray filter, a mixture of three color pigments can be used, or a black pigment can be used.

What is claimed is:

1. A method of fabricating a display panel having a front surface through which light from a luminous portion is emitted, comprising the steps of:

providing a back panel having a plurality of display cells each formed by coating on recessed portions of said back panel fluorescent material emitting red, green or blue light, said recessed portions being arranged in an array;

disposing a front panel on a front surface side of said back panel so as to cover said recessed portions, said front panel having a plurality of electrodes, each electrode corresponding to a respective display cell and causing said respective display cell to emit light through electric discharge;

coating resin material directly over said front panel, said resin material including red, green and blue resins corresponding to red, green and blue color regions of said back panel, thereby forming a resin lens layer;

pressing a molding tool against a front surface of said resin lens layer; and separating said molding tool from said front surface of said resin lens layer, thus forming a plurality of lenses on said resin lens layer, each of said plurality of lenses condensing light from a display cell to the front side of the display panel.

2. The display panel fabricating method defined in claim 1, wherein said luminous portion comprises a plurality of display cells disposed in a matrix form, each of said display cells emitting light.

3. The panel display fabricating method defined in claim 1, wherein said resin lens layer contains a pigment in a mixed state.

* * * * *